US006744000B1

(12) United States Patent
Bergmann et al.

(10) Patent No.: US 6,744,000 B1
(45) **Date of Patent: *Jun. 1, 2004**

(54) HIGH-VOLTAGE CIRCUIT BREAKER HAVING AN INSULATING NOZZLE

(75) Inventors: Ralf Bergmann, Berlin (DE); Volker Lehmann, Treuenbrietzen (DE); Hold Dienemann, Berlin (DE); Heiner Marin, Berlin (DE)

(73) Assignee: Siemens Aktiengesellschaft, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/622,886

(22) PCT Filed: Feb. 5, 1999

(86) PCT No.: PCT/DE99/00378

§ 371 (c)(1),
(2), (4) Date: Dec. 20, 2000

(87) PCT Pub. No.: WO99/44213

PCT Pub. Date: Sep. 2, 1999

(30) Foreign Application Priority Data

Feb. 25, 1998 (DE) ..... 198 09 088

(51) Int. Cl.[7] ..... H01H 33/88

(52) U.S. Cl. ..... 218/64; 218/63; 218/43

(58) Field of Search ..... 218/43, 46, 47, 218/48–50, 51, 52, 53, 60–64

(56) References Cited

U.S. PATENT DOCUMENTS

| | | | | |
|---|---|---|---|---|
| 4,342,890 A | | 8/1982 | Graf | |
| 4,378,477 A | * | 3/1983 | Graf | 218/48 |
| 4,939,322 A | | 7/1990 | Kashimura et al. | |
| 5,483,210 A | | 1/1996 | Otterberg et al. | |
| 5,925,863 A | * | 7/1999 | Zehnder et al. | 218/53 |

FOREIGN PATENT DOCUMENTS

| | | | |
|---|---|---|---|
| FR | 2 762 925 | | 11/1998 |
| JP | 01183024 | * | 7/1989 |

OTHER PUBLICATIONS

European Search Report No. EP 02 09 0369 dated Feb. 28, 2003.

* cited by examiner

*Primary Examiner*—Lincoln Donovan
(74) *Attorney, Agent, or Firm*—Kenyon & Kenyon

(57) ABSTRACT

In a high-voltage circuit breaker having two arcing contacts arranged coaxially relative to one another and having an insulating nozzle which in the closed state is blocked by a first arcing contact the first arcing contact has a shaft having a greater diameter and an end element having a smaller diameter, the shaft blocking a through-channel of the insulating body. The through-channel is cylindrical along a length that is smaller than the length of the end element. As a result, the extinguishing gas starts to flow when the end element is pulled back into the through-channel.

9 Claims, 1 Drawing Sheet

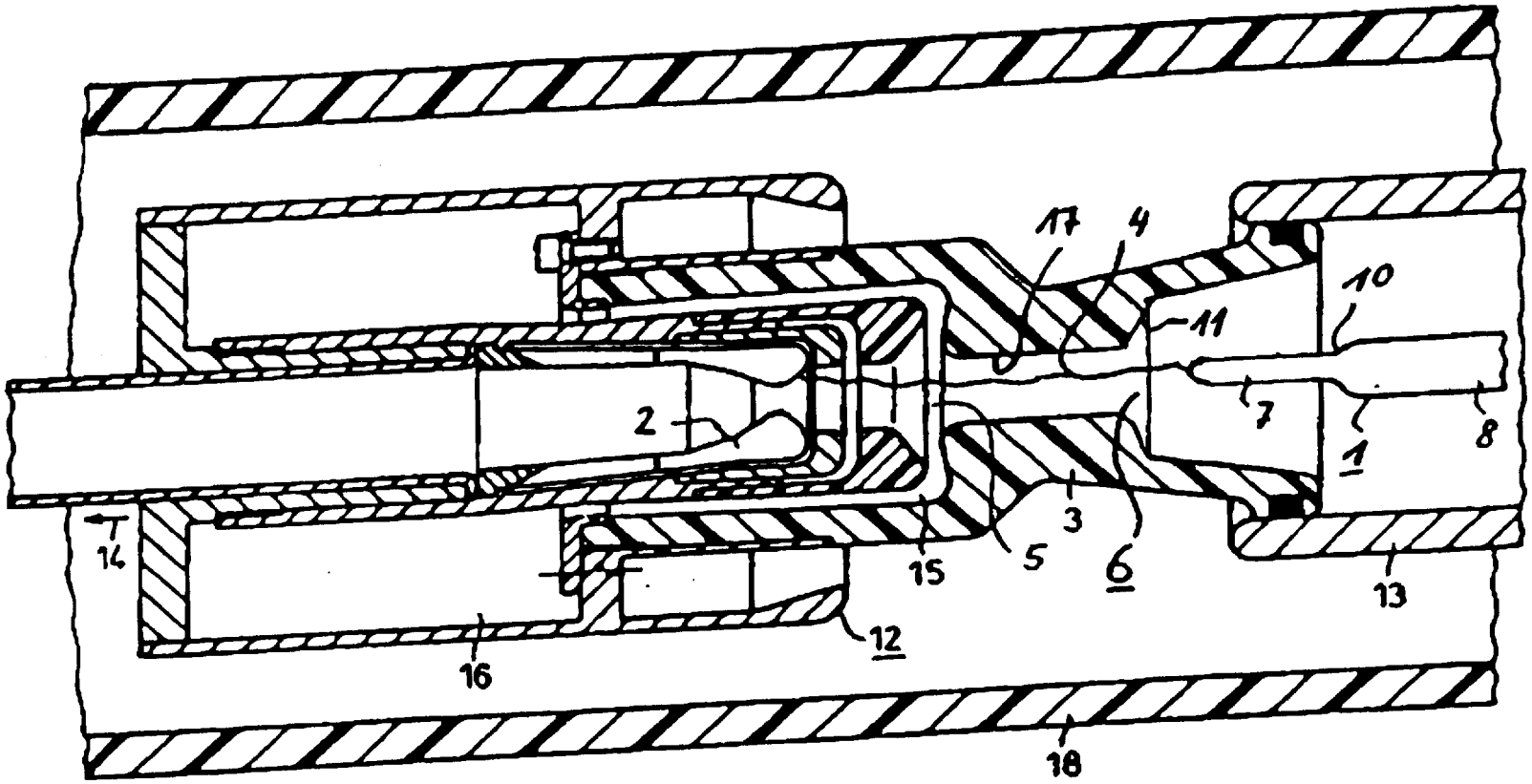
8
10
1
13
7
11
4
6
17
3
18
5
15
12
2
16
14

HIGH-VOLTAGE CIRCUIT BREAKER HAVING AN INSULATING NOZZLE

The present invention relates to a high-voltage circuit breaker having two arcing contacts arranged coaxially relative to one another and having an insulating nozzle which surrounds a contact gap between the arcing contacts at least during an opening operation. The nozzle has a through-channel that in the closed state is blocked by the first of the arcing contacts which has a shaft and an end element having a smaller diameter than that of the shaft.

BACKGROUND INFORMATION

A high-voltage circuit breaker is described in U.S. Pat. No. 4,342,890. In this switch, in the event of an opening operation, the arcing contacts are separated from one another in the axial direction, whereupon in many instances an arc is formed between them in the contact gap. The extinguishing gas that is present, usually $SF_6$, is heated up by this arc and flows into a heating area where it is stored temporarily. From there, when the current passes through zero and the arc is thus extinguished, the extinguishing gas, which is at high pressure, passes into the arc area and thus to the contact gap so as to cool it and prevent restriking. The insulating nozzle is provided in order to direct the flow of extinguishing gas, and to accelerate and control the flow of extinguishing gas. In particular, the through-channel of the insulating nozzle remains closed off by an arcing contact until the extinguishing position is reached, so that initially the pressure of the extinguishing gas can increase in the contact gap, and as a result the gas flows more rapidly once the through-channel is opened up.

In the space between the arcing contact that temporarily blocks the through-channel and the material of the insulating nozzle, dielectric problems may arise due to the strong field intensity there. An end element of the arcing contact may be designed so that its diameter is smaller than that of the shaft, so that during the time period when the arcing contact opens the through-channel there is a gas gap between the end element of the arcing contact and the wall of the through-channel that thus prevents or reduces the dielectric problems.

One problem associated with this is that in a gap of this kind extinguishing gas can escape prematurely from the contact gap and is therefore no longer available to help cool the contact gap subsequently.

SUMMARY

An object of the present invention is to create a high-voltage circuit breaker of the aforementioned kind in which, when the insulating nozzle is opened up by the arcing contact, as much extinguishing gas as possible is available in the area of the contact gap, and in which one can ensure dielectric strength in the area between the end element of the arcing contact and the material of the insulating nozzle.

According to an example embodiment of the present invention, this object is achieved in that the through-channel has a cylindrical part whose diameter is only slightly greater than the diameter of the shaft.

The design according to the present invention ensures that the through-channel remains largely closed off until it is opened by the shaft of the first arcing contact, and also ensures that once the through-channel has been opened up, the end element of the arcing contact is separated from the material of the insulating nozzle by enough of a gap so that the dielectric load in the space between the first arcing contact and the material of the insulating nozzle is reduced.

This also ensures that the through-channel is sealed effectively by the first arcing contact during the period when the shaft blocks the cylindrical part of the through-channel. For tolerance-related reasons, and to ensure the arcing contact can move freely, there is a small gap between the outside diameter of the shaft and the wall of the through-channel; however, this gap is small enough to ensure that little extinguishing gas escapes, in particular because at least at the beginning of an opening operation the through-channel is blocked along a considerable length so that the extinguishing gas has to flow through the gap along a considerable length in order to reach an expansion area. In practice this cannot be achieved using a conventional nozzle having a local narrow point.

According to an example embodiment of the present invention, the length of the end element is greater than the length of the cylindrical part.

According to a further example embodiment of the present invention, the length of the cylindrical part is greater than its diameter, in particular greater than twice the diameter. It is also advantageous if the length is greater than three times or four times the diameter of the cylindrical part.

The length ratios of the end element and the cylindrical part ensure that at the point in time when the free end of the end element is pulled back into the through-channel and the dielectric load between this free end and the wall of the through-channel is particularly great, the shaft has already opened up the through-channel. As a result, gas starts to flow at this point in time and thus prevents flashover at the free end of the end element.

Particularly if the cylindrical part is long, the resistance to flow is considerable thanks to the fact that the gap between the shaft and the wall of the through-channel is narrow, thus ensuring an effective seal.

The through-channel is not opened up until the contact pin has travelled a significant distance, so that substantial extinguishing gas pressure can build up in the heating area and, respectively, compression area over a long period of time before the extinguishing gas starts to flow.

According to a further advantageous embodiment of the present invention, a conical transitional area is provided between the end element and the shaft of the first arcing contact.

Furthermore, it is advantageous if the through-channel has a conical extension on the end of the cylindrical part that faces away from the second arcing contact.

BRIEF DESCRIPTION OF THE DRAWING

The FIGURE illustrates an example embodiment of the present invention.

DETAILED DESCRIPTION

A portion of the contact breaker unit of a high-voltage circuit breaker according to the present invention is schematically shown in the FIGURE.

As shown in the FIGURE, two arcing contacts 1,2 are arranged coaxially relative to one another in an insulating circuit breaker housing 16, which is made of, for example, porcelain or a composite material. First arcing contact 1 is stationary or, respectively, can be actuated separately, while second arcing contact 2, which is in the form of a tulip contact, can be actuated in the direction of arrow 14 in order to carry out an opening movement or in the opposite direction in order to carry out a closing movement.

An insulating body 3, which is in the form of an insulating nozzle made of polytetrafluoroethylene, is immovably connected to second arcing contact 2. Insulating nozzle 3 has a through-channel 6, which is penetrated and blocked by first arcing contact 1 in the closed state. A first continuous current contact 13 and a second continuous current contact 12, which in the closed state are also in contact with one another and carry the nominal current, are arranged radially outside insulating nozzle 3 and surround the latter.

In addition, a heating area 16, which is connected via a channel 15 to through-channel 6 of the nozzle, i.e., to the arcing area between the two arcing contacts 1,2, is formed.

During an opening operation, an arc 4 may arise between arcing contacts 1,2, and heats up the extinguishing gas, e.g. $SF_6$, in arcing area 5, causing it to expand. The extinguishing gas can then flow away into heating area 16 and is stored there temporarily until arc 4 is extinguished when the current to be switched passes through zero, whereupon the extinguishing gas flows back from heating area 16 into arcing area 5 via channel 15, which causes rapid cooling there, thus preventing arc 4 from restriking.

During the first phase of the opening operation, when first arcing contact 1 is still in electrically conductive contact with second arcing contact 2, through-channel 6 is still blocked by first arcing contact 1. In the cylindrical part the diameter of through-channel 6 is equal to the outside diameter of shaft 8 of first arcing contact 1.

Through-channel 6 is cylindrical along a significant part 17 of its length, so that in the event of an opening operation, first arcing contact 1 continues to block it until enough extinguishing gas pressure has built up in arcing area 5 and, respectively, heating area 16, and so that there is an effective seal thanks to the substantial axial overlap between shaft 8 and through-channel 6.

The second phase of the opening operation starts when first arcing contact 1 is separated from second arcing contact 2. At this point an arc, which heats up the gas in arcing area 5, causing it to expand, arises between arcing contact 1 and arcing contact 2. At this point in time, or slightly thereafter, shaft 8 leaves cylindrical part 17 of through-channel 6. At this point the latter is only blocked by end element 7, so that some of the expanded extinguishing gas can flow through the gap between end element 7 and cylindrical part 17 of through-channel 6, which reduces the dielectric problems in the gap.

The extinguishing gas that flows through increases the dielectric strength of the space between end element 7 and insulating body 3.

What is claimed is:

1. A high-voltage circuit breaker, comprising:

two arcing contacts; and an insulating nozzle that surrounds a contact gap between the two arcing contacts at least during a first phase of an opening operation, the insulating nozzle having a through-channel with a cylindrical part, a length of the cylindrical part being more than 2.5 times as great as a diameter of the cylindrical part, the length of the cylindrical part and the diameter of then cylindrical part being such that an escape of extinguishing gas in a direction of a free end of the insulating nozzle, from a heating area, occurs only in a second phase of the opening operation.

2. The high-voltage circuit breaker according to claim 1, wherein the length of the cylindrical part is at least three times as great as the diameter of the cylindrical part.

3. The high-voltage circuit breaker according to claim 1, wherein the length of the cylindrical part is at least four times as great as the diameter of the cylindrical part.

4. A high-voltage circuit breaker, comprising:

two arcing contacts; and an insulating nozzle that surrounds a contact gap between the two arcing contacts at least during an opening operation, the insulating nozzle having a through-channel with a cylindrical part, a length of the cylindrical part being more than 2.5 times as great as a diameter of the cylindrical part.

5. The high-voltage circuit breaker according to claim 4, wherein the length of the cylindrical part is at least three times as great as a diameter of the cylindrical part.

6. The high-voltage circuit breaker according to claim 4, wherein the length of the cylindrical part is at least four times as great as the diameter of the cylindrical part.

7. A high-voltage circuit breaker, comprising:

two arcing contacts; and an insulating nozzle that surrounds a contact gap between the two arcing contacts at least during a first phase of an opening operation, the insulating nozzle having a through-channel with a cylindrical part, a length of the cylindrical part being more than 2.5 times as great as a diameter of the cylindrical part, the length of the cylindrical part and the diameter of the cylindrical part being such that an escape of extinguishing gas is blocked during a first phase of the opening operation using one of the arcing contacts, and the escape of the extinguishing gas in a direction of a free end of the insulating nozzle, from a heating area, occurs only in a second phase of the opening operation.

8. The high-voltage circuit breaker according to claim 7, wherein the length of the cylindrical part is at least three times as great as the diameter of the cylindrical part.

9. The high-voltage circuit breaker according to claim 7, wherein the length of the cylindrical part is at least four times as great as the diameter of the cylindrical part.

* * * * *